United States Patent [19]

Rolke et al.

[11] 4,254,974

[45] Mar. 10, 1981

[54] BOLTING DEVICE, PARTICULARLY FOR COKE-OVEN DOORS

[76] Inventors: Rudi Rolke, Schubertstrasse 13, 4552 Herten; Heinz Tewes, Buer-Gladbecker-Str. 65, 4660 Gelsenkirchen, both of Fed. Rep. of Germany

[21] Appl. No.: 207

[22] Filed: Jan. 2, 1979

[30] Foreign Application Priority Data

Jan. 5, 1978 [DE] Fed. Rep. of Germany ..... 2800396

[51] Int. Cl.[3] ..... E05C 19/00

[52] U.S. Cl. ..... 292/259; 292/1; 292/144

[58] Field of Search ..... 292/259, 260, 1, 144, 292/201

[56] References Cited

U.S. PATENT DOCUMENTS

| | | | |
|---|---|---|---|
| 2,752,183 | 6/1956 | Doll | 292/1 |
| 2,798,752 | 7/1957 | Doll | 292/260 |
| 3,400,767 | 9/1968 | Hermiz | 292/144 X |
| 3,953,063 | 4/1976 | Steimann | 292/260 X |

*Primary Examiner*—Richard E. Moore

*Attorney, Agent, or Firm*—Michael J. Striker

[57] ABSTRACT

A bolting arrangement, especially for coke-oven doors in which the ends of a two-armed bolt turnable about a central axis of a bolt support engage under pressure of a pre-stressed compression spring located between said bolt support and the door panel transverse portions of hook-shaped strikes projecting from a frame defining an opening in a coke oven wall covered by the door panel to press the latter against the frame. A fluid operated piston is sandwiched between the end of the spring distant from the door panel to compress, when actuated, the spring to relief thereby the pressure on the bolt support and the bolt carried thereby so that the latter may be easily turned about the axis and disengaged from the strikes.

15 Claims, 3 Drawing Figures

BOLTING DEVICE, PARTICULARLY FOR COKE-OVEN DOORS

BACKGROUND OF THE INVENTION

The invention concerns a bolting device, especially for coke-oven doors.

Bolting, in particular of coke-oven doors, is accomplished mostly by means of L-shaped throw bolts which are mounted on the door panel in a manner allowing them to pivot, and which, when in locked position, will engage, from behind and with their free ends, a usually hook-shaped strike.

The sealing strips, frequently clamped to the door panel and normally adjustable, are usually constructed as metallic straight edges (so-called "hammer-tap edges"), but they can, of course, also be of a different construction. The advantage of metallic sealing edges, which allow later straightening by hammer tapping, lies however in the fact that they more readily allow compensating for thermal distortions, and by this ensure better sealing.

If done by mechanical means alone, locking of the door panel against the door frame, as described afore, has the disadvantage of requiring exceedingly great forces, for locking as well as for unlocking, in order to generate the high contact pressure required. To prevent the locking device from becoming loose under the varying thermal influences during operation, very small wedge angles have to be provided at the strike hooks, and these angles, in turn, will cause exceedingly high friction forces during locking as well as unlocking and thus make it difficult to perform satisfactory locking and unlocking with reasonable expenditure of force.

Numerous proposals to ameliorate this deficiency are known, most of which in the direction of so designing the pivot bearing, that serves to support the lock bolts and allows their rotation, that it can be movable in an axial direction. Attaching the pivot so that it can adjust itself in an axial direction will enable moving the bolt into locked position with a relatively small expenditure of force, and to perform the actual pressing-on only subsequently by appropriate axial adjustment of the pivot bearing serving as support, and allowing the rotation, of the lock bolts. The procedure on unlocking is such that initially the state of tension between lock bolts and strikes is relieved by adjustment of the pivot bearing, and only thereupon the lock bolt is turned to the unlocked position.

A known design according to this general principle of solution consists of interposing a spring cylinder between the axially adjustable pivot bearing and the bottom of the door panel, whereby suitable pre-compressed Belleville springs will generate the actual contact pressure, and to so design the pivot bearing for the throw bolt that it can be axially adjusted by an externally actuated threaded spindle, and that by actuation of the spindle, the pivot bearing will compress the Belleville springs beyond their pre-tensioning required for operation, and thus facilitate the locking and unlocking procedure every time before it is initiated. Relieving of the state of tension between the ends of the bolts and the strikes will allow throwing of the bolt, from this position to the unlocked position, with relatively small forces. Locking is accomplished in an analogous manner by first compressing the pre-loaded assembly of Belleville springs through actuation of the threaded spindle, and only thereupon throwing the bolt into the locked position, before the subsequent actuating of the spindle to relieve the spring back to the pre-loading required for operation and to concomitantly produce the required tension between lock bolts and strikes.

This known solution has led to considerable difficulties in practice, and is thus unsatisfactory in its results.

Disregarding the fact that this design is relatively complicated and thus costly to produce, it has proved to be difficult, on one hand to anchor the threaded spindle at the bottom of the spring cylinder so that it will not be torn out, and on the other hand to actuate it, for instance through an electric rotary drive, rapidly and exactly, as would be desirable in the interests of keeping time losses down to the possible minimum.

These disadvantages are, however, avoided by another known bolting device, (German Letters Patent No. 916 885), in which the axial adjustment of the pivot bearing which serves as the pivotal support of the bolt, is accomplished by a piston-operated adjusting cylinder with preferably hydraulic actuation.

On the other side, this principle of solution has the deficiency that the contact pressure required for operation, must be generated by the pressure medium within the adjusting cylinder. In practice, it might be difficult, if not quite impossible, to maintain the pressure medium contained within the adjusting cylinder at the required steady operating pressure over the entire locking period, considering that during the coking period, the cylinder and the pressure medium contained therein, are subjected to varying temperature influences.

Added to this is the disadvantage that in this case the adjusting cylinder must be of a type allowing pressure action on both sides, and alternating venting of both cylinder sides when actuating the adjusting device of the pivot bearing, which is time-consuming and also requires pressure media of different pressure levels.

Finally, a bolting device is known, (German Letters Patent No. 870 992), where the pressure action upon the spring, for the locking or unlocking procedure, is accomplished by a liquid or gaseous medium within a circular hose made of an elastic material, whereby the hose which is resting on one side against the cover of the housing, can be filled with the pressure medium, thereby forcing a pressure plate, that is linked to the shaft of the bolt, against the spring arranged at the other side of the pressure plate. At its outer rim, the pressure plate shows a gap against the housing containing it, and one or two pins are arranged at the rim to serve as stops to prevent complete compression of the hose by the spring. The pressure plate is supported at one end in a recess in the center of the housing cover, and at the other at the door end of the housing, through a journal at the shaft of the throw bolt, the shaft being connected to the pressure plate. The shaft has a thread which engages the pressure plate. Turning the throw bolt which is in fixed attachment to it, the entire shaft will thus also revolve.

On one side, this device has the disadvantage of consisting of quite many individual parts difficult to manufacture, and also of using an elastic pressure hose which is extremely failure-prone under the severe working conditions prevailing at a coke oven. On the other side, it is of disadvantage that a not inconsiderable quantity of the pressure medium is continually present between the pressure plate and the housing cover, so that in the event of possible leaks, quite a large quantity of the usually liquid pressure medium can escape, or, air can enter unnoticed and lodge as bubbles within the pressure hose. Just this last-named failure can be particularly troubling in hydraulic systems, as, under variable temperature conditions, especially under the usual temperature rise ensuing at the coke-oven door during the coking period, considerable pressure may be generated within the pressure hose, which will lead to further precompressing of the spring at the other side of the pressure plate and thus relieve the bolt, which will impair the sealing of the coke-oven door. This effect, however, will also already occur if the space wherein the pressure medium is contained is well vented, since every expansion of the volume of the pressure medium will fully affect the pressure plate.

SUMMARY OF THE INVENTION

The invention is now based upon the task of avoiding the disadvantage of the known solutions, and of creating a bolting device simple in installation and manufacture, and thus of low cost, which will also in a simple manner permit quick and precise adjusting of the pivot bearing prior to initiating locking or unlocking, and which will therefore be of simple and reliable actuation during the coking operation.

With these and other objects in view, which will become apparent as the description proceeds, the bolting arrangement according to the present invention, especially used for coke-ovens, mainly comprises a frame defining an opening, a door panel closing the opening, a releasable means for pressing the door panel into seating engagement with the frame, and comprising a pair of hook-shaped strikes fixed to and projecting transversely spaced from each other from the frame, bolt means comprising a pair of arms projecting to the opposite sides of a pivot axis, means mounting the bolt means for pivoting movement about this pivot axis and for movement in a direction of the latter between a locked position engaged with said strikes and a turned unlocked position, spring means interposed between the door panel and the mounting means, for pressing the door panel tightly against the frame and for urging the mounting means and the bolt means mounted thereon in axial direction away from the door panel so that the arms will be tightly engaged with the strikes to thereby prevent the bolt means to be turned to the unlocked position, and fluid-operated means for counteracting the force of the spring means to thus permit, when operated, turning of the bolt means to the unlocked position.

In this way it is possible, to effect the increase in the pre-compression of the spring, which is only a transitory requirement to facilitate the locking and unlocking procedure, in a, so to speak, instantaneous manner, by momentarily applying pressure in the hydraulic cylinder and subsequently fully relieving the cylinder of the pressure medium. Such a momentary application of the pressure medium within the pressure cylinder, can be effected in a very simple manner, f.i. during a pass of the pusher machine, using quick-connect couplings from the machine for the actuating, suitably at the same time, of the hydraulic cylinders for the upper and also the lower bolts of every coke-oven door. Relieving the hydraulic cylinders of the pressure medium will ensue, so to speak, automatically by the returning force of the spring that had been pre-loaded during operation.

Only one single line is therefore required at every coke-oven door, for the supply and return of the pressure medium, and whereby every door is provided with one half of the quick-connect coupling, linking, in parallel or in series, the two cylinders provided for every door.

BRIEF DESCRIPTION OF THE DRAWING

Two particularly preferred executions of the design are described below, in closer detail and with reference to the drawing, showing in.

DESCRIPTION OF THE PREFERRED EMBODIMENTS

Figure 1:
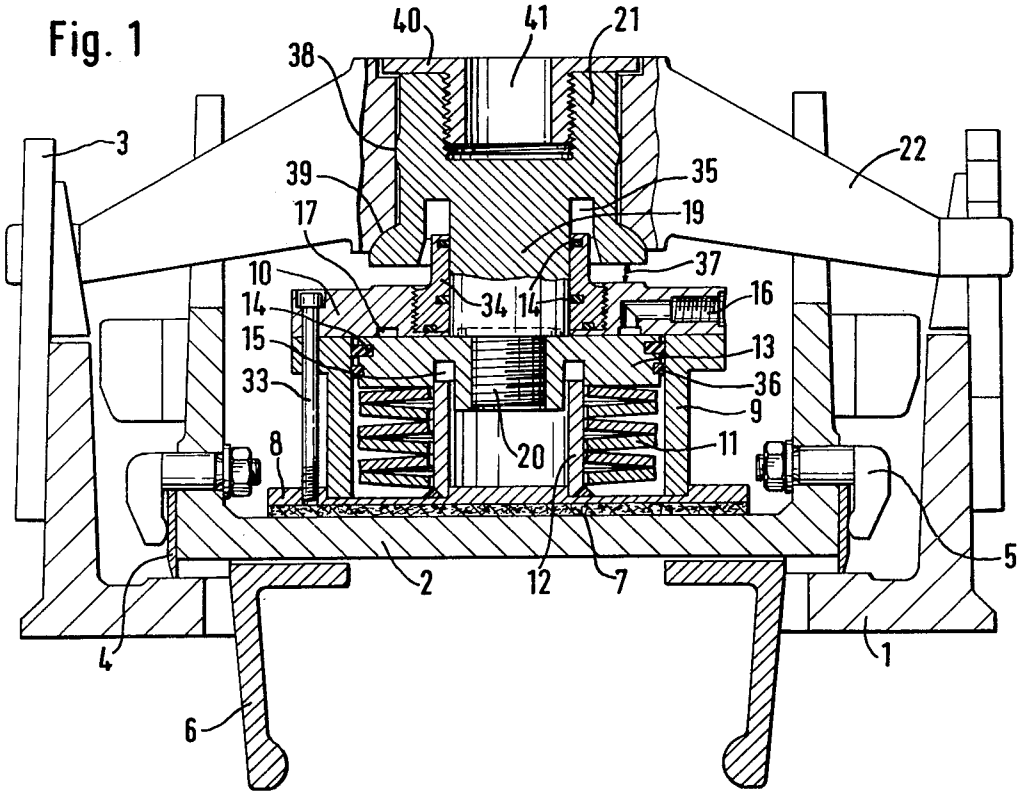
FIG. 1—Bolting device in operational bolted position (this is, simultaneously, the pressure-relieved state of the bolting device)
Figure 2:
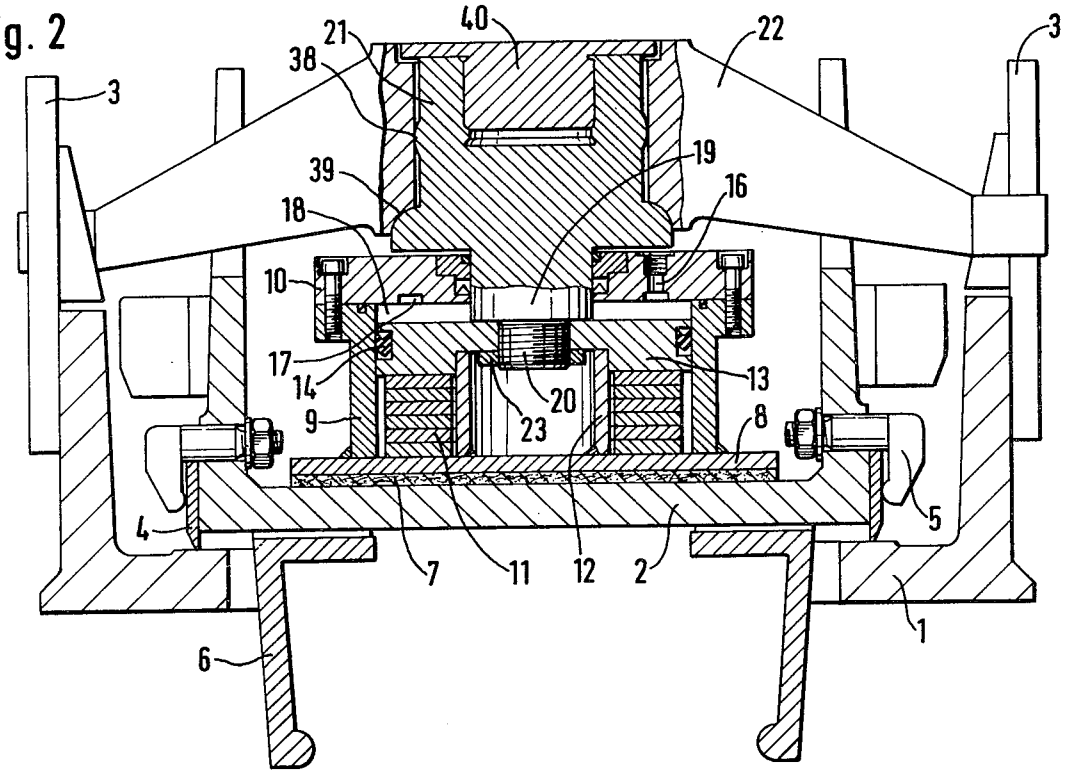
FIG. 2—Bolting device according to FIG. 1 in somewhat simplified construction, in the position initiating locking or unlocking with compressed set of springs, and FIG. 3—Schematic of the circuit for the actuation of the hydraulic cylinders of every coke-oven door from the pusher machine.

In FIGS. 1 and 2, the door frame is identified by 1, and the door panel by 2.

On the metallic door frames 1, the strikes 3, hook-shaped in the known manner, are mounted so that they protrude from the sides.

The door panel 2 is provided at both sides with adjustable metallic sealing edges 4, the edges of which are pressed against the sealing faces on the door frame 1. The adjustable metallic sealing edges 4 are held by friction through the clamping bolts 5.

No. 6 identifies a metallic retainer, serving as support for the refractory plug, not shown in the drawing that protrudes into the oven chambers.

At the outer side of the door panel 2, which is away from the oven chamber, the bottom 8 of a cylinder case 9 is attached, insulating material 7, f.i. in the form of asbestos, being interposed between the door panel and the bottom 8, and the case 9 is closed at its free face by the bolted-on cover 10, with sealants applied in-between.

A set of circular Belleville springs 11 is arranged within the cylinder housing 8, 9, 10, the springs being guided along their inner sides by the cylindrical sleeve 12 which is welded onto the bottom 8.

Furthermore, a piston 13 is arranged within the cylinder housing 8, 9, 10, the outer circumference of which is provided with packings 14, and which is guided along the inner wall of cylinder case 9. On its lower side, facing the Belleville spring set 11, the piston 13 is provided with a recess (annular groove) 15, the radial inner circumference of which is also guided along the outer wall of the cylindrical sleeve 12 during the adjusting travel of the piston 13.

The axial depth of this recess (annular groove) is also chosen to be of a dimension that will limit the axial adjusting travel of piston 13, by the latter coming into contact with the upper face of the guide sleeve 12.

Within the cover 10 of this combined hydraulic and spring cylinder, provision is made for a connecting passage 16 for the supply and return of the pressure medium, this passage leading towards chamber 18 between cylinder cover 10 and piston 13, and ending in a closed, circular shallow annular groove 17, arranged concentrically within the cylinder cover, the groove providing, upon the initiation of pressure, an even application of pressure upon the piston 13 when in relieved state, and also when piston 13 is pressed firmly against cylinder cover 10 by the pre-loaded set of Belleville springs 11. The annular groove 17, in its relation to the chamber 18, could, of course, also be arranged at the exactly opposite side and within the piston 13.

On account of the reduced depth required for installation, it is of particular advantage, as shown in FIG. 1, to have the connecting passage 16 for the pressure medium exiting at the circumference of the cover 10.

The cylinder cover 10 and also the piston 13 are provided with recesses centered at their axis, these recesses containing stem 19 within cylinder cover 10, and within piston 13 the connecting holding trunnion 20, of smaller diameter, of the pivot bearing 21 for the pivoting support of the L-shaped bolt 22.

At the inner side, facing the spring set 11, of the piston 13, the holding trunnion 20 of pivot bearing 21, is rigidly connected, in the direction of adjustment travel, to piston 13, by, f.i. a nut that is threaded on. The piston will abut the circular shoulder between stem 19 and trunnion 20 of pivot bearing 21 free of any play.

It is of particular advantage, to provide gaskets at both faces of the cylinder case 9, and to connect the cover 10 to the bottom 8 by means of fasteners 33. This will avoid distortions through thermal stress, which are otherwise hardly avoidable, when welding cylinder case 9 to bottom 8.

It is also beneficial to use a bearing bushing 34 as liner within the central recess in the cover 10 at the side facing the bolt and—in order to avoid an installation depth that is too large—to arrange, in the pivot bearing 21, an annular groove 35 to accommodate this bearing bushing.

It has, furthermore, proved of particular benefit, to provide double circular grooves at the sealing areas of piston 13 and/or bearing bushing 34 respectively, and to arrange therein a sliding ring 36, which can be made of f.i. plastics, and also the sealing elements 14 which are required in any case.

As can be seen from FIG. 1, the adjustment travel of piston 13, when acted upon by the pressure medium, can also be limited by the door-side face of the pivot bearing which in that case will become seated upon the cover 10. This arrangement necessitates that the distance 37 between these two surfaces, when in relieved state, is less than, or equal to, the free depth of the annular groove 15 of piston 13 above the cylindrical sleeve 12. It is then also of benefit to dimension the corresponding free depth of the annular groove 35 of pivot bearing 21 above the bearing bushing 34, equal to, or larger than, the above-noted distance, this, in order to prevent excessive pressure stress upon the bearing bushing 34.

It is also particularly advantageous, when the pivot bearing 21 is provided at its outer peripheral surface with an annular pressure ring 39 and an annular bead 38 for the bolt 22 even contact pressure of bolt 22 against strike 3, and also facilitate rotation of the bolt 22 against pivot bearing 21.

A central recess 41 in the plug 40, of pivot bearing 21, reduces the weight of the plug and is particularly suited to receive a pressure pin, known per se, which in case of failure of the bolting device can be braced against the door frame or the pusher machine, and which, by the exertion of pressure will relieve the bolt 21 from the outside, so that the locking or unlocking procedure can be initiated.

It has proved of particular benefit, to apply to spring 11, in both extreme positions of the piston 13, a pre-compression of 60,000–90,000 N respectively 10,000–170,000 N.

While FIG. 1 represents the locked state, where the set of Belleville springs is pre-compressed as required for the locked state during operation, FIG. 2 illustrates the condition prior to initiating locking or unlocking, in which the chamber 18 of the hydraulic cylinder is under the action of the pressure medium and in which the piston 13 has compressed the set of Belleville springs 11, and where the adjusting travel of the piston 13 is limited by contacting the free face of the cylindrical sleeve 12.

Figure 3:
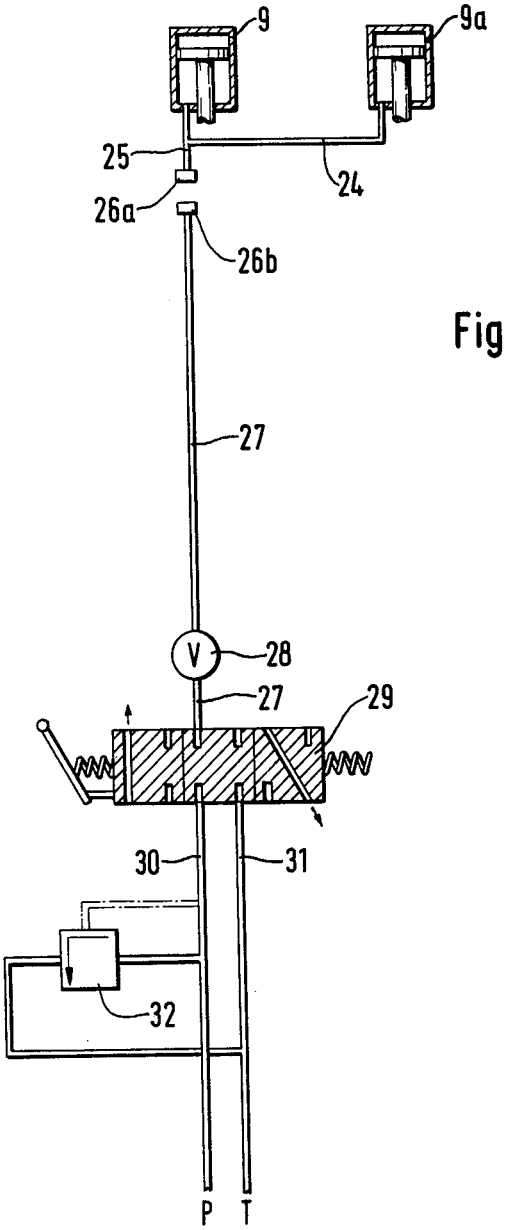

From FIG. 3 it will be seen that the two hydraulic cylinders 9 and **9*a* for the upper and lower bolt of a coke-oven door are arranged in a parallel circuit by means of line 24, and, in this way, connected to a common line 25, the end of which is formed by one half, 26*a***, of a quick-connect coupling that is fitted with a check valve.

The corresponding other half, **26*b*, of the quick-connect coupling forms the corresponding end of a line 27** leading to the pusher machine.

An adjustable restrictor valve 28, is arranged in the line 27 serving for the supply and return of the pressure medium, and from the valve 28, the line 27 leads to a solenoid-operated three-way valve 29. On the other side of the three-way valve 29, one each, pressure and return line 30 and 31 are connected, and these lines are connected within the pusher machine to a pressure generator or pressure accumulator respectively, and also to the return tank. No. 32 denotes a device for the equalization and regulation respectively, of pressure, which will automatically maintain the required pressure of the pressure medium, f.i. at a level of 27 bar.

Even if the bolting device according to this invention is of particular advantage when applied to coke-oven doors, it is, in principle, suitable for any other application where the closing element of a space, or of a vessel, subjected to strong variations in temperature, must be pressed-on firmly, and frequently released again, with a reasonable expenditure of power and time.

1. Door frame
2. Door panel
3. Strike
4. Sealing edges
5. Clamping bolts
6. Retainer
7. Insulating material
8. Bottom
9. Cylinder case
10. Cover
11. Belleville springs
12. Guide sleeve
13. Piston
14. Packings
15. Annular groove
16. Connecting passage
17. Annular groove
18. Chamber
19. Stem
20. Holding trunnion
21. Pivot bearing
22. Bolt
23. Nut
24. Line
25. Line
26. Quick-connect coupling
27. Line
28. Restrictor valve
29. Three-way valve
30. Line
31. Line
32. Pressure-regulating device
33. Fastener
34. Bearing bushing
35. Annular groove
36. Sliding ring
37. Distance
38. Support collar
39. Thrust collar
40. Plug
41. Recess

We claim:

1. In a bolting arrangement, especially for use in coke-ovens, a combination comprising, a frame defining an opening; a door panel for closing said opening; releasable means for pressing the door panel into seating engagement with the frame and comprising a pair of hook-shaped strikes fixed to and projecting transversely spaced from each other from said frame, bolt means comprising a pair of arms projecting to opposite sides of a pivot axis, means mounting said bolt means for pivoting movement about said pivot axis and for movement in direction of the latter between a locked position engaged with said strikes and a turned unlocked position, spring means interposed between said door panel and said mounting means for pressing said door panel tightly against said frame and for urging said mounting means and said bolt means mounted thereon in axial direction away from said door panel, so that said arms will be tightly engaged with said strikes to thereby prevent said bolt means to be turned to said unlocked position; and fluid operated means for counteracting the force of said spring means arranged in contact with said mounting means and adapted to preliminarily move said mounting means with respect to said door panel under fluid pressure acting on said mounting means to thus permit, when operated, turning of said bolt means to said unlocked position.

2. A combination as set forth in claim 1, and including a housing for said spring means comprising a hollow cylinder engaging with one end a bottom wall fixed to that surface of said door panel which faces away from said frame and having an opposite open end, a cover extending over said open end of said cylinder and fixed to the latter, said cover being provided with a central opening therethrough, said means mounting said bolt means including a pivot bearing and a steam projecting therefrom and passing in a sealed manner through said opening in said cover, said fluid-operated means comprising a piston slidably guided in said cylinder between said cover and said spring means and forming between itself and said cover a chamber, means connecting said piston to said stem of said mounting means so that the latter will move with said piston, and means for feeding pressure fluid into said chamber to thereby move said piston and said mounting against the force of the spring means in a direction in which said arms of said bolt means are disengaged from said hook-shaped strikes so that said bolt means may be easily turned about said pivot axis.

3. A combination as defined in claim 2, and including an insulating layer between said bottom wall and said door panel.

4. A combination as defined in claim 2, and including a central guide sleeve in said cylinder fixedly connected at one end to said bottom wall, said spring means being constituted by superimposed annular Belleville springs guided at its inner peripheral faces on said central guide sleeve, said piston being provided on a face thereof directed towards said spring means with an annular groove aligned with said guide sleeve and in which the other end of the latter will penetrate when said piston is moved by the pressure fluid against the action of said spring means, said other end of said guide sleeve being adapted to engage a transverse face of said groove in said piston to thereby limit the travel of the latter when acted upon by the pressure fluid.

5. A combination as defined in claim 2, and including gaskets on opposite ends of said hollow cylinder and fastening means fastening said cover to said bottom wall.

6. A combination as defined in claim 2, wherein said means for feeding pressure fluid into said chamber comprise a passage through said cover and having an outer end at the outer peripheral surface of the latter.

7. A combination as defined in claim 2, wherein said stem extends with a considerable clearance through said central opening in said cover, and including a bearing bushing arranged in said clearance about said stem, said pivot bearing being provided at the end thereof facing said cover with an annular cover into which an end portion of said bearing bushing projects.

8. A combination as defined in claim 7, and including sealing means between the peripheral surface of said piston and the inner surface of said cylinder and between said stem and said bearing bushing.

9. A combination as defined in claim 4, wherein said stem extends with considerable clearance through said central opening in said cover, and including a bearing bushing arranged in said clearance about said stem, said pivot bearing being provided at the end thereof facing said cover with an annular groove into which an end portion of said bearing bushing projects, wherein said pivot bearing has an end face directed to an opposite face of said cover, and wherein the distance between said end face of said pivot bearing and opposite face of said cover is, when said springs are not compressed, at most equal to the free depth of the annular groove in said pivot bearing and at least equal to the free depth of said annular groove in said piston.

10. A combination as defined in claim 2, wherein said bolt means are provided with a central aperture through which said pivot bearing extends, said pivot bearing being provided at the end thereof facing said cover with an annular support collar engaging said bolt means and intermediate said ends with an annular bead engaging the surface bounding said aperture.

11. A combination as defined in claim 2, wherein said pivot bearing is provided at its outer end facing away from said cover, with a central depression and including a plug having a central recess inserted in said depression.

12. A combination as defined in claim 2, wherein said spring means are provided, when not compressed by said piston, with a precompression of 60,000 to 90,000 N, and when fully compressed by said piston will exert a counterforce of 100,000 to 170,000 N.

13. A combination as defined in claim 2, wherein two bolting arrangements are provided for each coke oven panel, and wherein the means for feeding pressure fluid into the chambers of the respective bolting arrangements being arranged in parallel and jointly connected to a quick release fluid coupling.

14. A combination as defined in claim 13, wherein said quick release coupling, in turn, is connected to a connecting conduit and including three-port-three-position valve means intermediate said connecting conduit, a pressure conduit and a return conduit and constructed to connect in one of the end positions thereof said connecting conduit with said pressure conduit, in the other end position thereof said connecting conduit with said return conduit, and in an intermediate position thereof to interrupt the connection of said connecting conduit with said pressure conduit and said return conduit.

15. A combination as defined in claim 14, and including an adjustable throttle in said connecting conduit between said three-port-three-position valve means and said fluid coupling, and overpressure valve means between said pressure conduit and return conduit for maintaining a constant pressure in said pressure conduit.

* * * * *